United States Patent [19]

Jeppson

[11] Patent Number: 4,619,550

[45] Date of Patent: Oct. 28, 1986

[54] MICROWAVE METHOD AND APPARATUS FOR HEATING LOOSE PAVING MATERIALS

[75] Inventor: Morris R. Jeppson, Carmel, Calif.

[73] Assignee: CD High Technology, Inc., Georgetown, Tex.

[21] Appl. No.: 658,122

[22] Filed: Oct. 5, 1984

[51] Int. Cl.[4] ..... E01C 23/14; E01C 19/18

[52] U.S. Cl. ..... 404/80; 404/77; 404/81; 404/91; 404/92; 404/108; 366/25

[58] Field of Search ..... 404/75, 77, 79, 80, 404/81, 85, 86, 91, 92, 95, 101, 108; 126/271.2 A; 366/24, 25

[56] References Cited

U.S. PATENT DOCUMENTS

| | | | |
|---|---|---|---|
| 2,626,875 | 1/1953 | McConnaughay | 427/220 |
| 2,783,698 | 3/1957 | Bambi | 404/91 X |
| 3,263,052 | 7/1966 | Jeppson | 219/10.55 |
| 3,478,900 | 11/1969 | Jeppson | 219/10.55 |
| 4,000,000 | 12/1976 | Mendenhall | 106/280 |
| 4,062,127 | 12/1977 | Pfeiffer | 34/1 |
| 4,175,885 | 11/1979 | Jeppson | 404/77 |
| 4,189,238 | 2/1980 | Mendenhall | 366/25 X |
| 4,252,459 | 2/1981 | Jeppson | 404/77 |
| 4,252,487 | 2/1981 | Jeppson | 404/77 |
| 4,276,093 | 6/1981 | Pickermann | 404/95 X |
| 4,319,856 | 3/1982 | Jeppson | 404/79 |
| 4,332,478 | 6/1982 | Binz | 366/25 X |
| 4,347,016 | 8/1982 | Sindelar et al. | 126/271.2 A X |

OTHER PUBLICATIONS

Paper, author not known, "Recycling Systems—How They Stack Up", 2-2-78, 6 unnumbered pages, distributed by CMI Corporation.

Lazar et al, "A New Concept in Blanching", Food Technology, vol. 25, pp. 684–686, Jul., 1971.

Jeppson, "A Total Energy Concept for Mine-site Production of Electric Power and Shale Oil", undated 17 page paper prepared by Applicant in 1976, (see accompanying Information Disclosure Statement).

*Primary Examiner*—Stephen J. Novosad
*Assistant Examiner*—John F. Letchford
*Attorney, Agent, or Firm*—Phillips, Moore, Lempio & Finley

[57] ABSTRACT

Fragmented old asphaltic concrete or the like is recycled into new hot-mix by temporarily separating larger pieces from the smaller fragments, generating heat internally within the large pieces with penetrating microwave energy, separately heating the smaller fragments by exposure to hot gas, and then recombining and remixing the separately heated components. The old concrete can be heated very rapidly, highly uniformly and economically while avoiding asphalt degradation and pollution problems that can be caused by exposure to extreme high temperature and while avoiding the relatively high costs of heating the entire volume with microwave energy. Sorting, heating and mixing apparatus (11, 11*a*) embodying the invention may be made transportable to a site at or near a repaving operation or may be travelable along a roadbed to pick up old concrete and deposit new hot-mix or may be integrated into a fixed hot-mix plant (73, 73*a*, 73*b*) to enable, among other modes of operation, production of hot-mix wholly from old reclaimed concrete or production of hot-mix from both old and new materials in any desired proportions.

24 Claims, 7 Drawing Figures

92
94
96
97

Fuel
Air
AUXILIARY BURNER
116a
87a
120
Fuel
119
118
MICROWAVE POWER SUPPLY
117a
73a 87b
114b
73b
DRUM-MIXER
STAGE I
74b
127
129
CO-GENERATION POWER TRANSMITTER
MICROWAVE POWER SUPPLY
117b
128
126
Cool Air
125'
AFTER-BURNER
124
TURBINE ENGINE
122
123
121

MICROWAVE METHOD AND APPARATUS FOR HEATING LOOSE PAVING MATERIALS

TECHNICAL FIELD

This invention relates to paving technology and more particularly to methods and apparatus for heating fragmented asphaltic concrete or other loose paving material in order to prepare hot-mix for use in laying pavement.

BACKGROUND OF THE INVENTION

Deteriorated asphaltic concrete roadways or the like have traditionally been repaired by overlaying new material or by removing some or all of the old pavement and replacing it with new paving material. This practice has become extremely costly. Petroleum based asphalt is expensive and the transporting of materials to and from the paving site adds substantial energy, equipment and labor costs.

Economies can be realized by recycling deteriorated old asphaltic concrete instead of hauling such material to a dump site and discarding it as has been a common practice in the past. Deteriorated asphaltic concrete is heated until the asphalt binder becomes liquid or semi-liquid. The heated material may then be remixed and relaid to form new pavement either at the original site or elsewhere. Little or no new paving materials may be needed and in many cases substantial savings in equipment and transportation costs can be effected.

My prior U.S. Pat. Nos. 4,319,856; 4,175,885; 4,252,459 and 4,252,487 describe methods and apparatus for recycling deteriorated asphaltic concrete in place at a roadbed or the like by using microwave energy preferably in combination with hot gas to heat the old pavement deeply and rapidly. The heated material is then remixed on the roadbed and recompacted to form a restored pavement.

Alternatively, old asphaltic concrete or at least an upper layer of such pavement can be broken up by cold milling, ripping or similar techniques. The fragmented material is then lifted from the roadbed and transported to a recycling plant where it is heated and remixed. The resulting hot-mix may then be returned to the original site for use in repaving operations or may be used to form new pavement at some other location.

Recycling operations of the kind in which fragmented asphaltic concrete is removed from the roadbed for reprocessing have heretofore been less efficient and more costly than is desirable and have been subject to other problems and limitations as well.

In hot-mix plants, aggregates or rock fragments of various sizes are typically heated by exposure to very high temperature combustion gases produced by burning a fuel. The aggregates may, for example, typically be given a prolonged exposure to gas temperatures of around 700° F. (371° C.) as heating efficiency and throughput are both enhanced by such high temperatures. Asphalt itself cannot be subjected to such temperatures without undesirable results. Asphalt breaks down when heated to high temperatures, producing hydrocarbon fumes at temperatures in the range from about 300° F. (149° C.) to about 500° F. (260° C.) and smoke at higher temperatures. Thus very high temperatures degrade asphalt and create pollution problems.

This difference in tolerance of high temperatures is easily accomodated where hot-mix is being produced from virgin aggregates and new asphalt. The asphalt is not added into the mix until after the aggregates have traveled through the highest temperature regions of the heating and mixing apparatus and have reached a point where gas temperatures are substantially lower. This is not possible where the raw material is fragmented old asphaltic concrete as in that case the asphalt is already present and bound together with the aggregates. Asphalt deterioration and pollution problems can be dealt with in the recycling of old asphaltic concrete by lowering processing temperature and increasing processing time but this reduces productivity and increases costs very substantially.

The problem is further complicated in that fragmented asphaltic concrete typically consists of loose pieces of varying size, ranging from less than a millimeter to several centimeters in diameter. A hot gas stream transfers heat into the surfaces of the concrete pieces. Heat is then conducted slowly towards the centers of the pieces. The larger the piece the longer it takes for internal temperature to approach the gas temperature. By the time the center of a one inch (2.54 cm) piece has reached a desirable hot-mix temperature such as 250° F. (121° C.) for example the centers of pieces smaller than about ⅜th inch (0.95 cm) have been at full gas temperature, such as 700° F. (371° C.) for example, and asphalt coatings are fuming, smoking and degrading.

One known practical solution to the above discussed problems is to combine the recycling of old asphaltic concrete with the manufacture of new hot-mix. Fresh uncoated aggregates are heated to above hot-mix temperatures by exposure to a very hot gas stream and thereafter, at a point where gas temperatures are substantially lower, both fresh asphalt and fragmented old asphaltic concrete are added in. The old asphaltic concrete pieces are heated by heat transfer from the new aggregates. Mixing of the old and new materials during the heat transfer period produces a high quality hot-mix.

Recycling by combining old and new materials in the manner described above resolves some problems at the cost of introducing others. The process is inherently only partial recycling. Substantial amounts of new aggregates and new asphalt are necessarily consumed although there may often be sufficient old asphaltic concrete available to meet the needs of current paving operations if it could be economically heated without the addition of new materials, without asphalt degradation and without generating difficult pollution problems.

Recycling by combining heated new aggregates with old asphaltic concrete chunks is particularly unsuited to the type of paving operation where old pavement is to be broken up, reprocessed in a movable heating and mixing device at or near the site and then relaid at the same site as repaving. Hauling in the necessary new materials adds substantially to costs and results in the production of more hot-mix than is needed.

Another known process for heating fragmented old asphaltic concrete in a drum mixer or the like is not subject to asphalt degradation, excessive pollutant generation nor any requirement for unneeded new materials but has been undesirably costly as heretofore practiced. In particular, microwave energy may be used to heat the material in a very rapid and uniform manner.

Microwave energy, which is not itself heat, penetrates into the material and converts to heat in a distributed manner throughout the volume of each rock fragment. Large chunks and small fragments of the concrete are heated at substantially the same rate. Because of differences in molecular structure, the microwave energy does not directly heat the asphalt content to a very appreciable extent but the asphalt is quickly heated and softened by heat transfer from the rock. Consequently, the temperature of the mass can be quickly and uniformly raised to the desired level without overheating of the asphalt component.

Economic considerations may have inhibited the use of microwave energy for the above described purposes. Microwave is an inherently costly heating medium as compared with generating heat by combustion of a fuel. Energy losses occur during the conversion of electrical power to microwave energy, in the transmitting of such energy to the substance which is to be heated and because of heat generation in the walls, access structures and other components of the heating apparatus itself instead of in the substance that is intended to be heated. Further energy losses occur in engines used to drive generators for supplying electrical power for installations where utility electrical power may not be available such as in travelable heating apparatus that may be used at non-urban roadways or similar paving sites of other kinds. Microwave equipment is costly itself in comparison with fuel combustion heating apparatus.

The technical advantages of microwave energy as a heating medium for recycling fragmented asphaltic concrete or the like could be more effectively realized by reducing the energy inefficiencies and high costs of the prior practice which are described above.

The present invention is directed to overcoming one or more of the problems discussed above.

SUMMARY OF THE INVENTION

In one aspect, the present invention provides a method of heating a paving material which contains loose component fragments of different sizes. Steps in the method include separating larger fragments of the material that exceed a predetermined size from smaller fragments that are of lesser size, heating the smaller fragments by directing heat from an external heat source to the surfaces of the smaller fragments, and separately heating the larger fragments at least in part by generating heat internally within the larger fragments by directing microwave energy into the larger fragments. The larger and smaller fragments are recombined and remixed while in the heated condition.

In another aspect, the invention provides apparatus for heating fragmented paving material that includes loose fragments of different sizes, the apparatus having first heating means for applying heat to the surfaces of fragments within a first heating chamber, second heating means for generating heat internally within fragments in a second heating chamber by directing microwave energy into the fragments in the second heating chamber, and sorting means for separating large fragments that exceed a predetermine size from small fragments of lesser size. The apparatus further includes means for transferring the small fragments from the sorting means to the first heating chamber and for transferring the large fragments from the sorting means to the second heating chamber, means for recombining the large fragments with the small fragments following microwave heating of the larger fragments, and means for remixing the recombined large and small fragments.

The invention provides the hereinbefore described technical advantages of microwave energy as a medium for heating fragmented old asphaltic concrete or the like in a much more economical manner than has heretofore been realized. Smaller fragments of the concrete, which may be more than half of the total mass in some cases, are diverted away from the microwave heating region and are more economically heated by, for example, exposure to hot combustion gases having temperatures below those which cause asphalt degradation and which can crete difficult pollution problems. The separately heated components are then remixed while in the heated condition to provide a high quality hot-mix of highly uniform temperature and in which the original gradation of aggregate sizes is preserved. The invention is adaptable to fixed recycling plants, to travelable heating and remixing apparatus which can be temporarily located at or near repaving operations and also to repaving operations which progress along a roadbed or the like using old pavement which is temporarily lifted for heating and remixing and which is then relaid substantially at the original location. The invention does not necessarily require the addition of new aggregates into old asphaltic concrete which is being recycled while being compatible with the combining of old and new material in any desired proportions when that is appropriate to a particular operation.

DESCRIPTION OF PREFERRED EMBODIMENTS

Figure 1:
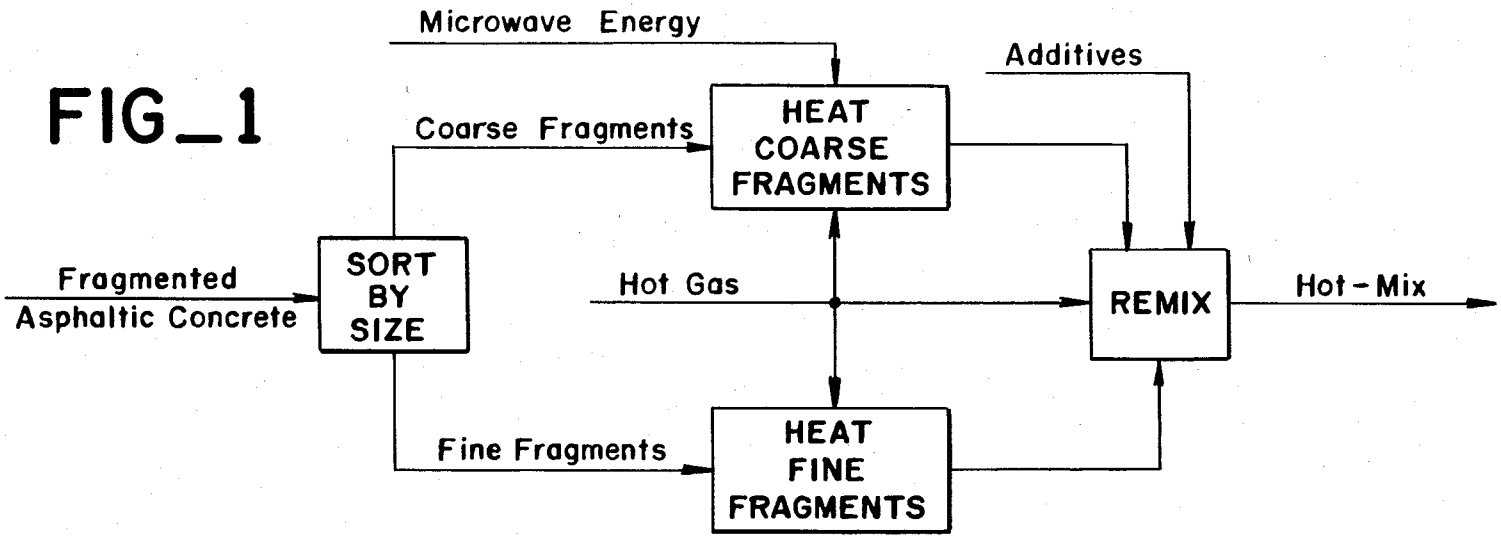
FIG. 1 is a block diagram illustrating steps in a method for recycling fragmented old asphaltic concrete in accordance with one embodiment of the invention.

Asphaltic concrete which has been broken up by cold milling or other similar techniques typically includes fragments having a gradation of different sizes. Minute particles are intermixed with larger pieces and chunks ranging up to well over an inch (2.54 cm) in diameter. Referring now to FIG. 1 of the drawings, the method of the present invention realizes substantial economies in the recycling of such material, provides a high quality product and inhibits pollutant production by separating the larger fragments from the smaller ones and separately heating the two size ranges by different heating techniques. The fragments of different size ranges are then recombined while in the heated condition and are remixed to provide new hot-mix which may be relaid at the original site or elsewhere.

The larger pieces, herein termed the coarse fragments, are heated at least in part by exposure to microwave energy although it is advantageous in many cases to apply some supplemental heat from a hot gas flow or other direct heat source to the surfaces of the coarse fragments. The microwave energy instantly penetrates the coarse fragments and is converted to heat in a distributed manner throughout the interior regions of such fragments. Consequently, the interior temperatures of the coarse fragments can be very rapidly raised to the point where the asphalt binder content becomes liquid or semi-liquid and the material is in condition for remixing. Asphalt degradation and unacceptable pollutant production are avoided as the material need not be exposed to the very high temperatures that causes such effects.

The smaller pieces, herein termed the fine fragments, are separately heated by the less costly technique of applying externally generated heat to the surfaces of the fragments and relying on inward thermal conduction of such heat to raise the interior temperatures of such fragments. The fine fragments may, for example, be heated by being exposed to a flow of hot combustion gases or the like. To avoid asphalt degradation and to suppress pollutant production, the temperature of the gas flow may be lower than is customary where new aggregates are being heated without loss of productivity or throughput as only small fragments are present. Externally applied heat reaches the centers of small fragments more quickly than it does in large fragments. Thus if only small fragments are present, gas temperatures may be reduced without necessarily increasing processing time.

Remixing of the separately heated coarse and fine fragments produces a new hot-mix in which the original gradation of aggregate sizes and the original proportion of asphalt to aggregates is preserved. In instances where a change in such proportions may improve the quality of the hot-mix, supplemental aggregates and/or asphalt may be added in during the remixing step. Other additives such as conditioners may also be introduced during the remixing stage.

Heat transfer between the coarse and fine fragments during the remixing step results in an equalization of temperature throughout the mass in instances where the separate heating may have produced different temperatures within the two kinds of fragments. Such heat transfer also brings the temperature of any supplemental asphalt, aggregates or other additives into equilibrium with that of the general mass. Although it is not necessary in all cases, heating may be continued during the remixing step by directing a hot gas flow to the material during the remixing operation.

In a typical example of the practice of the method, asphaltic concrete fragments having diameters of $\frac{3}{8}$ inch (0.95 cm) or more may be separated out by screening, centrifugal separation or the like and then be subjected to the above described coarse fragment microwave heating. The remaining portion of the concrete is subjected to the separate fine fragment heating step as described above. In a typical case where the asphaltic concrete has been fragmentized by cold milling, this will result in about 40% of the material being subjected to microwave heating while the remaining 60% constitutes the fine fragments that are heated by exposure to hot gas. It should be understood that these specific values are presented for purposes of example only as the minimum size of fragments which are treated as coarse fragments may be varied from the $\frac{3}{8}$" (0.95 cm) value given above in either direction depending on such factors as the properties of the particular batch of concrete, the relative capacities of the different types of heating equipment that are available and other considerations.

The reclaimed asphaltic concrete may, for example, be heated to a hot-mix temperature of about 250° F. (121° C.) by the above described combination of heating steps although other output temperatures are also appropriate. Heating of old asphaltic concrete from a temperature of 70° F. (21° C.) to 250° F. (121° C.) by microwave energy alone typically requires a microwave energy input of about 24.7 Kilowatt hours (88.8 MJ) per ton (907 kg) assuming that about 90% of the microwave energy is absorbed in the concrete and assuming the initial water content of the concrete to be about 4% of the total mass. This microwave energy consumption can be reduced, by a factor of as much as one fourth or more, by conducting the microwave heating of the coarse fragments in the presence of a hot gas flow around the surfaces of such fragments as previously described. Microwave heating tends to drve internal moisture to the surfaces of substances such as concrete fragments. The very high input of energy needed to vaporize water may then be largely supplied by the hot gas flow instead of by the more costly microwave energy.

The hot gas flow used for heating the fine fragments and also any gas flow applied to the coarse fragments to supplement the microwave heating is more effective from the heat transfer standpoint if it is initially as hot as possible consistent with the need to avoid damage to the asphalt content and with the need to avoid unacceptable pollutant generation. These undesirable effects begin to occur when the asphalt reaches temperatures in the range from about 350° F. (177° C.) to about 500° F. (260° C.) depending on the composition of the particular concrete. In some cases, the initial temperature of the gas flow in the heating region may be somewhat above the temperature at which the asphalt is damaged since a period of time is needed for the asphalt to rise to the temperature of the ambient gas and during that period the gas flow is being cooled by heat transfer to the concrete. As a practical matter, the maximum input gas temperature suitable for a particular batch of concrete can be determined empirically by examining the output hot-mix for indications of asphalt degradation.

Fuel consuming engines may be present in many installations where the method is practiced in order to drive generators which supply electrical power to the microwave heating system or for other purposes. Around 70% of the chemical energy content of fuels consumed in internal combustion engines is normally exhausted as heat, primarily in the exhaust gas flow, rather than being productively used. Very substantial economies can be realized by using such engine exhaust gas flows, in whole or in part, in the practice of the present method rather than separately consuming additional fuel in order to produce hot gas.

Engine exhaust gases typically have temperatures in the range from about 800° F. (427° C.) to about 900° F. (482° C.). The exhaust gas flow can readily be cooled, if necessary, to the temperatures discussed above that are suitable for the present method by intermixing cool air with the flow, for example.

In many cases it is preferred to conduct the coarse fragment heating step and the fine fragment heating step simultaneously but these steps can be performed sequentially by temporarily storing the first heated component, preferably in a thermally insulated environment, for subsequent remixing with the later heated component. Other variations in the process may also be made. For example, the fine fragment heating step can be combined with the remixing step. The microwave heated coarse fragments may be fed into a drum mixer or the like into which hot gas is directed while the fine fragments are fed into the mixer in an initially unheated condition, suitable apparatus for the purpose being hereinafter described. All such variations of the method have in common the temporary separating out of the larger coarse fragments for separate heating at least in part by microwave energy followed by recombination with the fine fragments which are heated by other means.

The method may be practiced by utilizing sorting, heating and mixing equipment of known forms but it is advantageous in many cases to employ new and differing apparatus specialized for the purpose.

Figure 2:
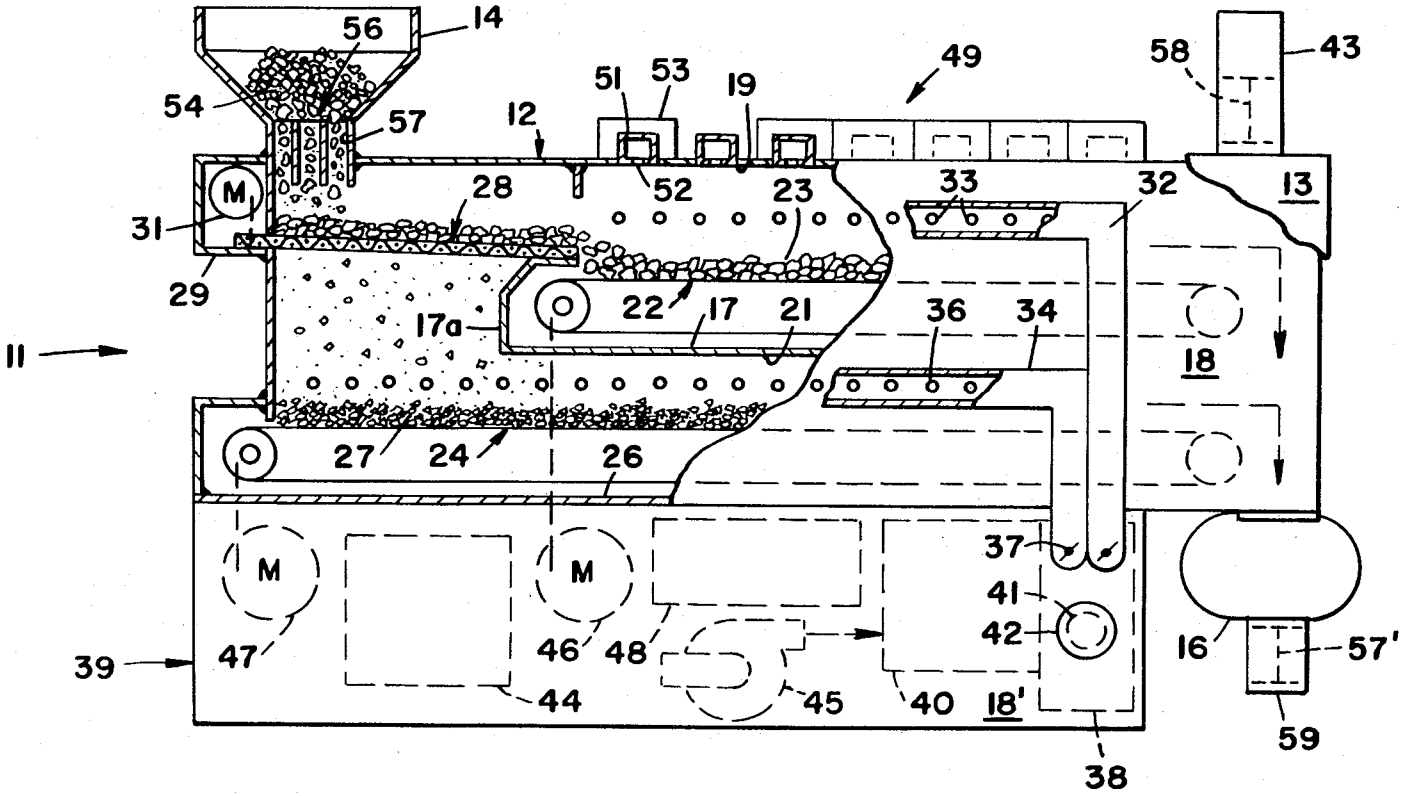
FIG. 2 is a broken out side elevation view of apparatus for heating and remixing fragmented old asphaltic concrete or the like in accordance with another embodiment of the invention.

FIG. 2 depicts an asphalt concrete recycler 11 with which the method may be performed on a continuous process basis. Recycler 11 has a sorting and heating chamber housing 12 formed of electrically conductive metal and which is preferably enclosed in thermal insulation 13. A hopper 14, also formed of conductive metal, is situated at one end of housing 12 to receive the fragmented asphaltic concrete which is to be recycled. Hot-mix is delivered from the recycler 11 through a pugmill 16 which may be of known design and which is located below the opposite end of housing 12, the pugmill being the remixing device in this embodiment.

A horizontal electrically conductive partition 17 extends between the sidewalls 18 of housing 12 at the central region of the housing to divide the central region into an upper or coarse fragment heating chamber 19 and a lower or fine fragment heating chamber 21. A first continuous belt conveyor 22 is disposed above partition 17 to carry coarse fragments 23 through the upper heating chamber 19 and a second longer belt conveyor 24 is situated above the floor 26 of housing 12 to carry fine fragments 27 through the lower heating chamber 21.

The end 17*a* of partition 17 which is closest to hopper 14 extends upward and then backward for a short distance over conveyor 22 to support one end of a metallic vibrating screen conveyor 28 which performs the sorting operation in this embodiment. Vibrating screen conveyor 28 extends below hopper 14 and into a compartment 29 which contains the motor 31 for vibrating the conveyor. The mesh size of vibrating screen conveyor 28 is selected to cause fine fragments 27 to drop through and onto conveyor 24 while coarse fragments 23 are traveled along the screen conveyor 28 and deposited on conveyor 22.

An upper hot gas input duct 32 extends along the central region of each housing sidewall 18 adjacent the upper heating chamber 19 and is communicated with that chamber at spaced apart intervals along its length by a series of apertures 33 through the sidewall. A lower hot gas input duct 34 extends along each housing sidewall 18 adjacent the lower heating chamber 21 and is communicated with the lower chamber at intervals along its length by another series of apertures 36.

Ducts 32 and 34 receive hot gas, through separate flow control valves 37, from a manifold 38 located in a lower housing 39 which is below heating chamber housing 12. An adjustable air blower 45 directs air through a fuel combustor 40 to supply hot gas of controllable temperature to manifold 38. Manifold 38 may also receive exhaust gases from engines, if such gases are available, through an opening 41 in sidewall 18' of housing 39. Opening 41 is sealed with a removable closure cap 42 during operations where such hot exhaust gases are not available from fuel consuming engines at the work site. Hot gas is exhausted from the recycler 11 through an exhaust stack 43 which extends upwardly from the heating chamber housing 12 at the output end and which may connect with scrubbers or other pollution suppression equipment of known form in instances where that is necessary.

The lower housing 39 in this embodiment also contains a fuel supply tank 44 for combustor 40, motors 46 and 47 for driving conveyors 22 and 24 respectively and the microwave power supply circuitry 48 each of which may be of known form.

Means 49 for directing microwave energy into the coarse fragments 23 in this embodiment includes a plurality of spaced apart waveguides 51 which extend transversely across the top of the heating chamber housing 12 above conveyor 22. Waveguides 51 are of the leaky type described in my prior U.S. Pat. No. 3,263,052 that release microwave energy from each of a series of apertures 52 which are spaced apart along the underside of each such waveguide in the present embodiment to direct such energy downwardly towards the coarse fragments 23 in this embodiment.

Figure 4:
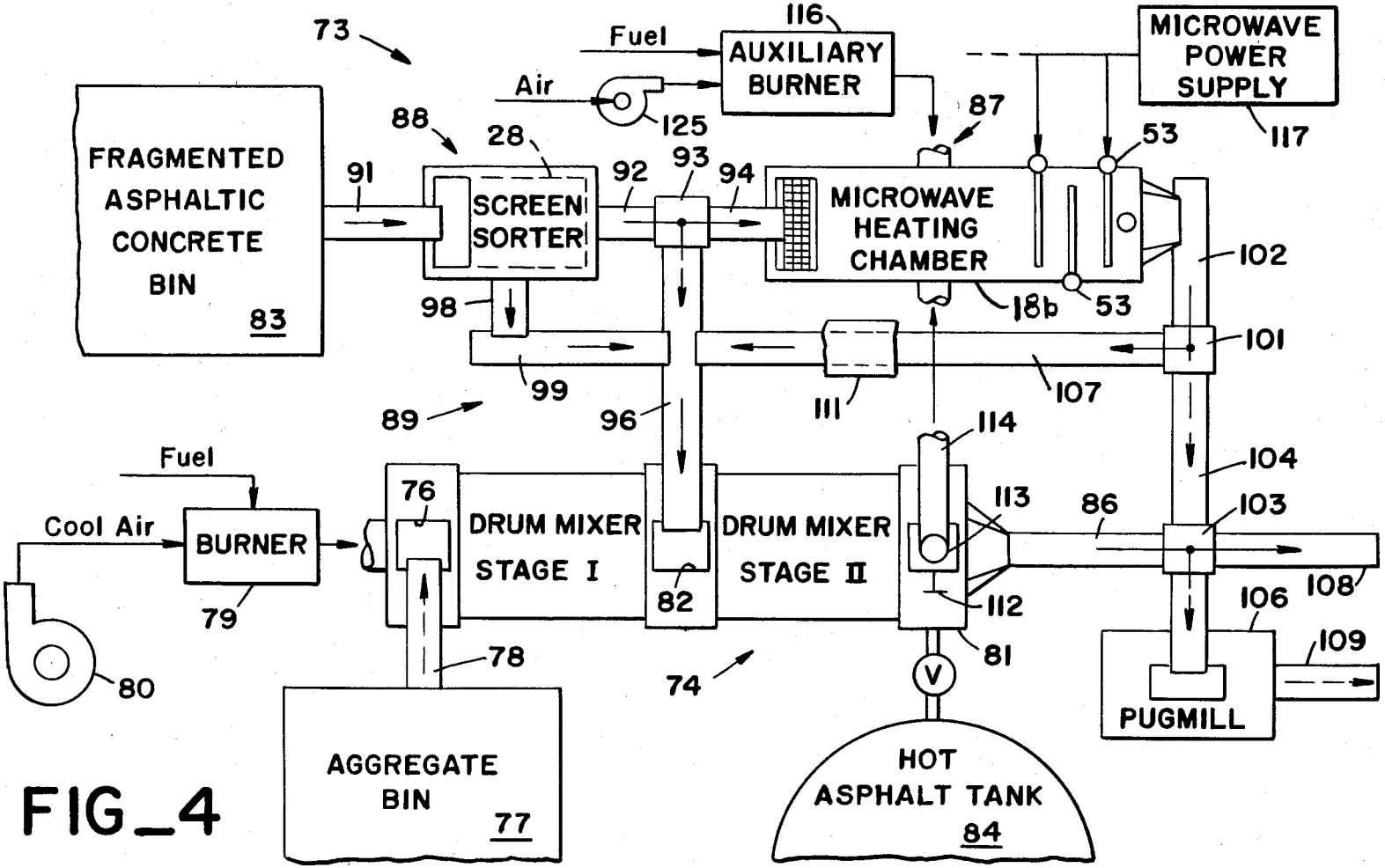
FIG. 4 is a partially schematic plan view of a fixed hot-mix plant adapted to the practice of embodiments of the invention.

Each waveguide 51 is energized by a microwave generator 53, which may be a magnetron tube for example, situated at one end of the waveguide. Referring now to FIG. 4, uniformity of the microwave heating is enhanced if alternate ones of the microwave generators 53 are at opposite sides of the heating chamber housing 18*b*. Other arrangements of the waveguides 51 and microwave generators 53 may also be employed such as, or example, arrangements of the known form which each generator 53 jointly energizes two or more of the waveguides 51.

Referring again to FIG. 2, it is necessary to prevent release of significant levels of microwave energy into the surrounding environment for safety reasons and in order to avoid interference with other forms of electronic equipment. This is accomplished in part by forming the heating chamber housing 12 of electrically conductive metal including welding or otherwise microwave sealing the junctures between components of the structure. Conductive surfaces reflect microwave rather than transmitting such energy.

Microwave energy may propagate through an opening in a conductive surface if the opening has a dimension, parallel to the surface, that approaches or exceeds the microwave wavelength. Governmental regulations in the United States of America at this time require that industrial microwave systems operate at a frequency of either 915 MHz or 2450 MHz which frequencies correspond to wavelengths of about 33 cm and 12 cm respectively. The inlet passage 54 of hopper 14 may exceed those dimensions at least in many cases. Release of microwave energy through the hopper 14 can be prevented in such cases by disposing an electrically conductive gridwork 56 in the hopper that subdivides the passage 54 into a plurality of smaller passages 57 which are large enough to pass coarse fragments 23 while being too constricted to transmit the microwave energy. Similar gridworks 57' and 58 can be disposed in the outlet 59 of pugmill 16 and in exhaust stack 43 in instances where such components otherwise define openings which could transmit microwave energy. Alternately, a lining of energy attenuating dielectric material of the type described in may prior U.S. Pat. No. 3,365,562 may replace the gridworks 56, 57 and 58 in hopper 14, pugmill 16 and stack 43. Release of energy through hopper 14 can also be blocked simply by maintaining a column of asphaltic concrete in the hopper that is of sufficient height to substantially fully absorb upwardly propagating microwave.

In operation, fragmented asphaltic concrete or the like is fed into hopper 14 and drops to vibrating screen conveyor 28. The screen conveyor 28 carries coarse fragments 23 onto the upper belt conveyor 22 while the smaller fine fragments 27 drop through the screen conveyor onto lower belt conveyor 24. The microwave energy then generates heat within the coarse fragments 23 causing a rapid temperature rise throughout the interior volume of each such fragment. Surface regions of the coarse fragments 23 are additionally heated, in this example, by exposure to the hot gas flow in the microwave heating chamber 19. The surface regions of moisture containing substances tend to be somewhat underheated, owing to the cooling effect of evaporating water, if microwave heating alone is used. The supplementary heating by hot gas counteracts this tendency and also provides an economical means of supplying some of the sizable heat input needed to vaporize water.

Concurrently with the predominately microwave heating of the coarse fragments 23, the fine fragments are separately heated in the lower chamber 21 by exposure to the hot gas flow in that chamber. While such heating depends on the relatively slow process of thermal conduction of heat inwardly from the surfaces of the fine fragments 27, heating in the lower chamber 21 can be accomplished in the same time period as the microwave heating in the upper chamber 19 owing to the smaller size of the fine fragments. Temperature differences in the material processed in the two chambers 19 and 21, if present, are removed by the subsequent intermixing of such materials.

The heated coarse fragments 23 and fine fragments 27 recombine in the course of dropping from conveyors 22 and 24 respectively and enter pugmill 16 where a thorough remixing occurs to provide new hot-mix in which the original gradation of aggregate sizes is preserved. Supplementary asphalt, conditioners or other additives may be fed into pugmill 16 for intermixing with the reprocessed asphaltic concrete in instances where that is desirable.

Variations in the construction of the recycler 11 are readily possible. As one example, the upper conveyor 22 and underlying partition 21 may be removed if vibratory screen conveyor 28 is made sufficiently lengthy to carry the coarse fragments 23 from hopper 14 to pugmill 16 provided that the screen conveyor is formed of electrically conductive material and has openings too small to transmit significant amounts of microwave energy into the lower heating chamber 21.

Figure 3:
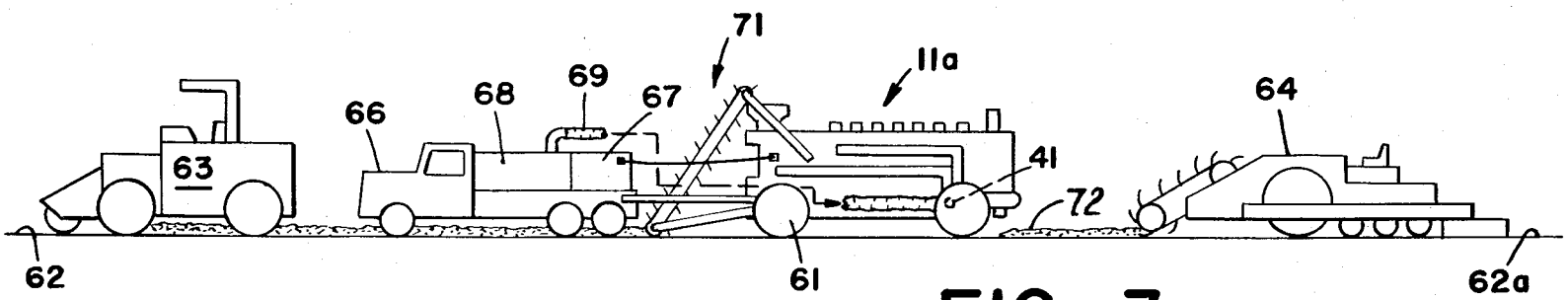
FIG. 3 is a side elevation view of equipment which may be used to resurface a deteriorated roadbed or the like in accordance with an embodiment of the invention.

Recycler 11 has been described above as a fixed installation. The recycler 11 can be constructed with a size which enables it to be transported, by trucking for example, to a site at or close to a repaving operation in which old asphaltic concrete is to be reprocessed and relaid. Referring now to FIG. 3, an essentially similar recycler **11*a* may be provided with roadwheels 61 or other ground engaging gear and be towed along a roadway 62 that is to be repaved behind a cold milling vehicle 63 and in front of a paver vehicle 64** both of which vehicles may be of known constructions.

The cold milling vehicle 63 fragmentizes the old concrete of roadway 62 or at least an upper layer of such concrete. Recycler **11*a* is towed, in this example, by a truck 66 which also carries at least one generator 67 for supplying electrical power to the recycler and at least one fuel consuming engine 68 for driving the generator. A flexible, thermally insulative conduit 69 transmits the hot exhaust gases from engine 68 to the previously described exhaust gas input opening 41 of the recycler. The recycler 11*a* is further equipped with an elevator 71 of the known form suitable for lifting the fragmentized concrete from roadway 62 into the input hopper 14** of the recycler.

Operation of the recycler **11*a* in the manner previously described, while progressing continuously along roadway 62, results in the depositing of a windrow 72 of new hot-mix along the roadway. The paver vehicle 64 follows recycler 11*a* picking up and relaying the hot-mix of windrow 72 to provide a resurfaced roadway 62*a***.

Referring now to FIG. 4, the invention may be integrated into a fixed hot-mix plant 73 to enable a number of different modes of plant operation ranging from conventional preparation of hot-mix from wholly new materials, through combined use of old concrete and new materials in any desired proportion, to production of hot-mix using only reclaimed old concrete.

Plant 73 includes a number of components that are also present in prior plants of the type that reprocess old asphaltic concrete by combining it with heated new aggregates and new asphalt. Such components include a two staged drum-mixer and heater 74 with an inlet end port 76 into which new aggregates can be fed from a bin 77 by a conveyor 78 or other means. A flow of hot gas is directed through the drum-mixer 74 by an air blower 80 and fuel burner 79 which flow is, in prior installations, exhausted at the outlet end 81 of the apparatus. Such drum-mixers also have a reclaimed material port 82 at an intermediate position between the ends of the apparatus which can receive fragmented old asphaltic concrete from another bin 83. The reclaimed material port 82 is situated at the intermediate location along the drum-mixer 74 as the gas flow has cooled by the time it reaches that location, by heat exchange with the new aggregates, to a temperature that does not damage the asphalt content of the old concrete. Heated, liquid new asphalt from a tank 84 may be fed into the drum-mixer 74 downstream from reclaimed material port 82. Hot-mix is delivered from outlet end 81 of the drum-mixer 74 by a conveyor 86 or the like.

A serious limitation in the conventional manner of operating such drum-mixer heaters 74 is that efficient operation necessarily requires a sizable input of new aggregates and asphalt although there may often be sufficient old concrete available to meet the demand for hot-mix if it could be recycled without new material or with a reduced amount of new material. The uncoated new aggregates are needed to isolate the old concrete from the very high input gas temperature which would otherwise damage the old asphalt and cause unacceptable pollutant production. In the conventional manner of operation input gas temperature cannot be reduced sufficiently to avoid such problems without greatly increasing processing time and thereby reducing output of hot-mix per unit time.

Additional components of plant 73 integrate the present invention into the system to enable efficient operation with wholly old material or combinations of old and new material in any desired proportions. The additional components include a microwave heating chamber 87 and sorting means 88 for separating large or coarse fragments of old asphaltic concrete from smaller fine fragments.

Microwave heating chamber 87 in this embodiment need not necessarily have the sorting, fine fragment heating and mixing means of the previously described recycler and thus may be a simpler conveyorized microwave heating chamber of any of a number of known constructions or may be of the advantageous novel form disclosed in my copending U.S. patent application Ser. No. 587,565, filed Mar. 8, 1984 and entitled Conveyorized Microwave Heating Chamber with Dielectric Wall Structure.

Sorting means 88 may be a vibrating screen conveyor 28 as previously described with reference to FIG. 2 or other device of the type capable of separating objects on the basis of size. A rock crusher having sorting means that can be used without necessarily crushing materials is often present in a hot-mix plant and can be used for the present purposes. Actual crushing of the reclaimed asphaltic concrete may be advisable in some cases if overly large fragments are present but in general such crushing should be minimized or avoided. Crushing tends to break up individual rock pebbles within the old concrete. Consequently the average size of the aggregate pieces is reduced to what may be a less than optimum value. The total area of exposed rock surface within a given volume of aggregates increases if the average size of individual rock pieces is decreased. Thus greater amounts of costly asphalt are needed to coat such surfaces if the average size of the rock pieces is reduced.

Referring again to FIG. 4, a belt conveyor system 89 enables carrying of materials between the major components of the plant 73 in any of several patterns of movement to provide for different modes of operation as will hereinafter be described. In this example, one conveyor belt 91 delivers the fragmented asphaltic concrete from supply bin 83 to sorting means 88 and another conveyor 92 carries the coarse fragments from the sorting means to a first conveyor switching station 93. From switching station 93 the coarse fragments may be carried to microwave heating chamber 87 by a conveyor 94 or to the reclaimed material port 82 of drum-mixer 74 by a different conveyor 96.

Figures 5, 6, 7:
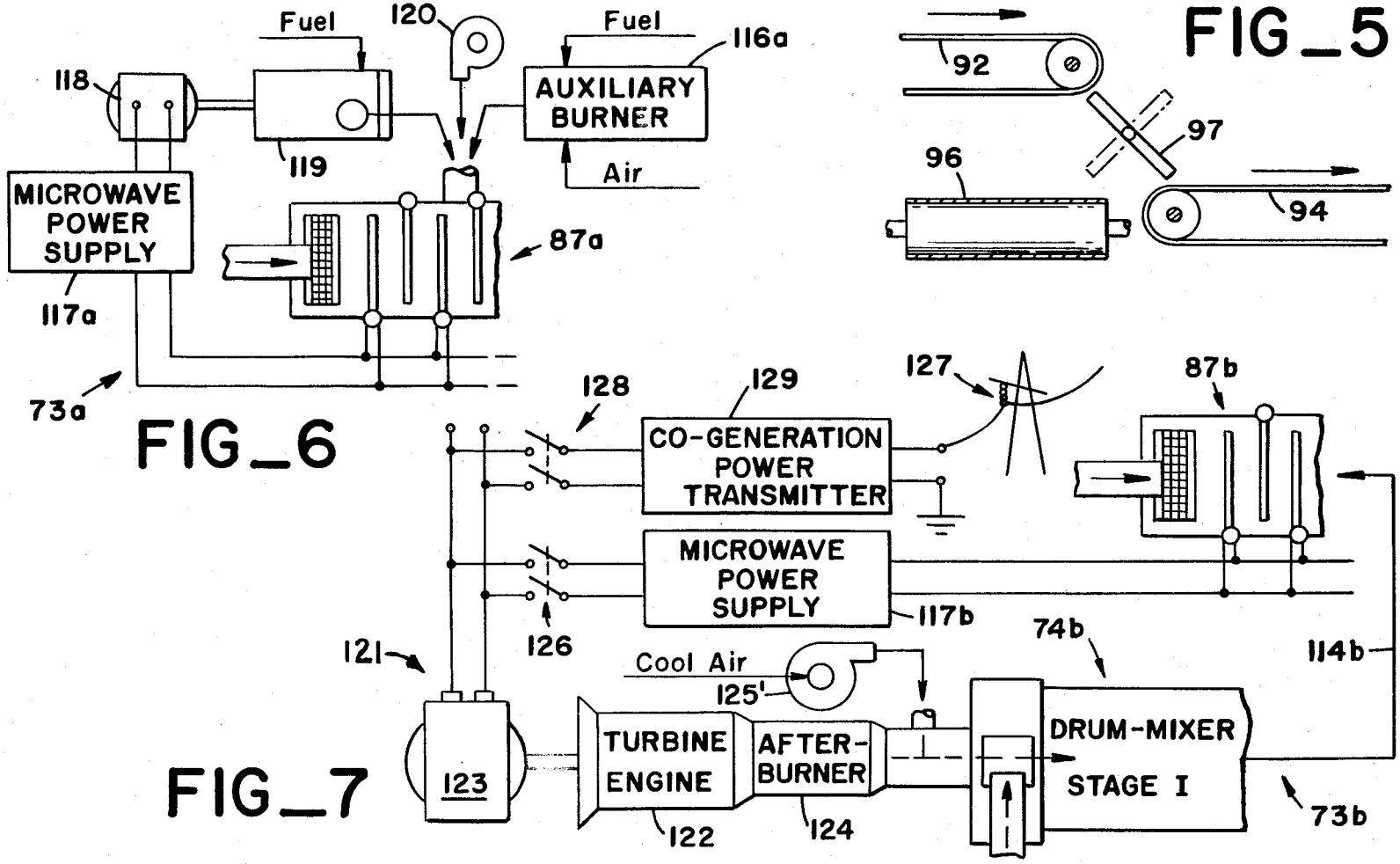
FIG. 5 is a diagrammatic depiction of means for switching flows of material between conveyors as employed in the hot-mix plant of FIG. 4.
FIG. 6 is a plan view of a modification of portions of the hot-mix plant of FIG. 4 in which motor generator means are used to produce both electrical energy and hot gases for use in heating operations.
FIG. 7 is a plan view of another modification of the hot-mix plant of FIG. 4 and illustrating another use of motor generator means for supplying hot gas and electrical power to components of the plant.

One suitable construction for the switching station 93 is depicted in FIG. 5 although other structures for switching material flows between conveyors running in different directions may also be used. In this example, the output end of conveyor 92 is situated somewhat above the level of the input ends of conveyors 94 and 96 and is spaced a small distance from conveyor 94 while being directly above conveyor 96. A turnable inclined chute 97 is situated between the ends of the three conveyors 92, 94 and 96 in position to carry material from conveyor 92 to conveyor 94 when in a first orientation depicted in solid lines in FIG. 5 and to carry such material to conveyor 96 when turned to an alternate orientation depicted in dashed lines in FIG. 5.

Referring again to FIG. 4, further components of the conveyor system 89 include a conveyor 98 which delivers fine fragments from sorting means 88 to still another conveyor 99 that deposits such material on the previously described conveyor 96 for delivery to the reclaimed material port 82 of drum-mixer 74. Heated coarse fragments from microwave heating chamber 87 are delivered to a second switching station 101 by another conveyor 102. From switching station 101 the coarse fragments may be carried through a third switching station 103 and on to pugmill 106 by a conveyor 104 or, alternately, may be deposited on conveyor 96 by another conveyor 107.

Conveyor 86 carries hot-mix from drum-mixer 74 to switching station 103 where such material is transferred to a first plant output conveyor 108 or, alternately, is transferred to conveyor 104 for delivery to pugmill 106 if further mixing is desirable. Another conveyor 109 receives hot-mix from the pugmill 106 and constitutes a second plant output conveyor.

The above described conveyors of conveyor system 89 are preferably covered by shrouding 111 which may be formed of thermally insulative material in the case of conveyors such as 86, 96, 102, 104, 108 and 109 that carry heated product.

To provide a hot gas flow into microwave heating chamber 87 for supplemental heating as previously described, a valve 112 at the exhaust stack 113 of drum-mixer 74 enables diversion of a selectable portion of the drum-mixer exhaust into an insulated conduit 114 which connects with the microwave heating chamber. An auxiliary source of hot gas, which includes an air blower 125 and fuel burner 116 in this example, is also coupled to the microwave heating chamber 87 to provide gas flow during modes of operation in which exhaust from drum-mixer 74 is not available and to supplement the exhaust gas flow when appropriate.

In a first mode of operation, plant 73 may be used to produce hot-mix from wholly new aggregates and new asphalt by an essentially conventional process. New aggregates are fed into drum-mixer 74 by conveyor 78, blower 80 and burner 79 are activated and new asphalt from tank 84 is sprayed into the mix within the cooler region of the drum-mixer away from the inlet 76 end. Conveyors 86 and 108 deliver the hot-mix through switching station 103. The other components of the plant 73 which are depicted in FIG. 4 need not be operated.

It is also possible to operate the plant 73 on the basis of the previously described prior practice in which a limited amount of old concrete can be reclaimed in the course of utilizing new aggregates and asphalt. In such a mode of operation, drum-mixer 74, burner 79 and conveyors 78, 86 and 108 are operated essentially in the manner previously described for the first mode of operation. In addition, old concrete fragments are fed into reclaimed material port 82 of drum-mixer 74 by removing sorting screen 28 from sorting means 88 and actuating conveyors 91, 98, 99 and 96. Alternately, the sorting screen 28 can be replaced with an unperforated element and the unsorted old concrete may then be delivered to the drum-mixer 74 by actuating conveyors 92 and 96. The proportion of old reclaimed material which can processed under this mode of operation is limited for the reasons hereinbefore discussed.

A third mode of operation enables efficient and economical production of hot-mix wholly from old reclaimed concrete. Drum-mixer 74, sorting means 88 and microwave heating chamber 87 are each actuated. Temperature of the gas flow from burner 79 is adjusted down to the hereinbefore described values that avoid damage to the asphalt content of old concrete. Conveyors 98, 99, and 96 operate to carry fine fragments from sorting means 88 to reclaimed material port 82 of drum-mixer 74. Conveyors 92 and 94 deliver coarse fragments from sorting means to microwave heating chamber 87 through switching station 93. The heated coarse fragments from microwave heating chamber 87 are then also delivered to the reclaimed material port 82 of drum-mixer 74 through switching station 101 by conveyors 102, 107 and 96. After remixing and further heating of the coarse and fine fragments within drum-mixer 74, conveyor 86 delivers the new hot-mix to plant output conveyor 108 through switching station 103.

The reduced maximum gas temperature in drum-mixer 74 avoids asphalt damage and resolves pollution problems but does not reduce productivity as it would in the case in the previously described conventional process. In the present instance, a sizable portion of the total required heat input to the product is supplied in the microwave heating chamber 87. Thus heat input to the drum-mixer 74 itself can be reduced accordingly without slowing the overall processing rate.

In a variation of the third mode of operation described above, heated coarse fragments from microwave heating chamber 87 may be delivered to pugmill 106 by conveyors 102 and 104 thereby bypassing the drum-mixer 74. Heated fine fragments from drum-mixer 74 are also carried to pugmill 106 by conveyors 86 and 104. Remixing of the two components then occurs in pugmill 106 which delivers hot-mix to plant output conveyor 109.

Plant 73 may also be operated to recycle old asphaltic concrete by processing the unsorted material in microwave heating chamber 87 alone. Screen 28 of the sorting means is replaced with an unperforated element and conveyors 92 and 94 then carry both coarse and fine fragments to the microwave heating chamber 87. The heated material is then carried to pugmill 106, for remixing, by conveyors 102 and 104. As previously discussed this is less energy efficient and more costly than where coarse and fine fragments are separately heated by different techniques but may be appropriate under some special conditions. The plant 73 may be operated in this manner, for example, at times when it is desired to use drum-mixer 74 for preparing hot-mix from wholly new aggregates and asphalt in the conventional manner.

Electrical power for operating components of the plant 73 including the microwave power supply 117 may of course be obtained from the local utility power system. It is a general assumption that industrial facilities can be more economically operated by purchasing electrical power from the local utility system rather than generating such energy on site with motor-generator sets that consume costly fuel. Motor generator sets having a diesel or turbine engine typically exhibit a fuel energy to electrical energy conversion efficiency in the 24% to 29% range which seemingly compares unfavorably with the 33% to 38% conversion efficiencies typical of large centralized electrical power plants. At least in some areas, on site power generation may in fact be more energy efficient in the case of the present invention as it is possible to utilize a sizable proportion of the exhaust heat of a motor-generator set as well as the electrical power output.

Referring to FIG. 6, for example, an electrical generator 118 provides the electrical power which operates the microwave power supply 117*a*. Generator 118 is driven by a fuel consuming engine 119 which is of the diesel form in this example although other types of engine may also be used. Exhaust gas from engine 119, which may be intermixed with air from a blower 120, is transmitted to microwave heating chamber 87*a* to provide some or all of the hot gas flow for the previously described supplemental direct heating within the microwave chamber. An auxiliary burner 116*a* may also be present to provide additional hot gas in instances where the engine 119 exhaust may be insufficient for the purpose. Other portions of the plant 73*a* of FIG. 5 may be similar to the previously described example.

Referring now to FIG. 7, even greater energy efficiency may be realized under some conditions by providing a higher capacity on site motor generator set 121 or a larger number of such sets and by utilizing the electrical energy and heat energy outputs in additional ways.

In the hot-mix plant 73*b* of FIG. 7, one or more fuel burning turbine engines 122 function as the hot gas source for drum-mixer 74*b* and also drive one or more high capacity generators 123. An afterburner 124, in which additional fuel may be combusted, may be situated between turbine engine 122 and the drum-mixer 74*b* to provide additional hot gas in instances where it may be needed. Air from a blower 125' may be mixed into the exhaust gas flow to control temperature. As in the previously described examples, the exhaust 114*b* of hot gas from drum-mixer 74*b* may be delivered to the microwave heating chamber 87*b* to provide supplemental direct heating the the chamber.

Depending on capacity, generator 123 may supply some or all of the electrical power requirements of plant 73*b*. Microwave power supply 117*b*, for example, may be connected to the generator 123 by closing a switch 126 and other electrically operated components (not shown) may be similarly coupled to the generator.

Electrical utility power systems may purchase privately produced electrical energy and are in fact required to do so in some regions. This can further enhance the favorable economics of on site power generation in a plant 73*b* of the present kind. Generator 123 may be selectively coupled to the local electrical utility system lines 127 through a control switch 128 and co-generation power transmitter 129 of the known form which matches voltage, frequency and phase. Surplus power produced during plant operation may be delivered to the utility system and the motor generator set 121 may be operated for this purpose during periods when the plant 73*b* is otherwise shut down.

The invention has been herein described with respect to the processing of asphaltic concrete in particular but is also applicable to other paving materials which include loose fragments or pieces of differing sizes that heat at different rates when subjected only to externally applied heat. For example, it has been proposed to make use of low cost sulphur, rather than asphalt, as an aggregates binder in thermoplastic concrete and the invention is equally applicable to such material.

While the invention has been described with respect to certain specific embodiments, many variations are possible and it is not intended to limit the invention except as defined in the following claims.

I claim:

1. A method of recycling fragments of asphaltic concrete or the like comprising the steps:

sorting said fragments on the basis of size to separate coarse fragments exceeding a predetermined size from fine fragments of lesser size, separately heating the coarse and fine fragments with different heating procedures by directing said fine fragments to a first location and heating said fine fragments thereat at least primarily by exposure to hot gas, and by directing said coarse fragments to a second separate location and heating said coarse fragments thereat at least primarily by directing microwave energy into said coarse fragments to generate heat internally therein, recombining said fine and coarse fragments following said separate heating of said coarse fragments, and mixing said recombined fine and coarse fragments while in the heated condition to provide new hot-mix.

2. In a method of heating a paving material which contains loose component fragments of different sizes and wherein larger fragments of said material that exceed a predetermined size are separated from smaller fragments of said material that are of lesser size and wherein said larger and smaller fragments are separately heated, the steps comprising:

performing said heating in part with microwave energy which generates heat internally within fragments of the material and in part with heat from an external heat source that is directed to the surface of fragments, including heating said smaller fragments at least predominately by directing heat from said external heat source to the surfaces of said smaller fragments, and using said microwave energy at least predominately for generating heat internally within said larger fragments by directing microwave energy into said larger fragments at a location separate from the location of said smaller fragments, and recombining and remixing said larger and smaller fragments while in the heated condition.

3. The method of claim 2 including the steps of obtaining said paving material by fragmenting old thermoplastic pavement at successive portions of a roadbed or the like, performing said separating step and said heating steps and said recombining and remixing step while progressing along said successive portions of said roadbed or the like, and relaying the heated and remixed material to form restored pavement on said roadbed or the like.

4. The method of claim 2 wherein said paving material is fragmentized old concrete formed of old aggregates and old thermoplastic binder, including the further step of heating new aggregates and new thermoplastic binder, and combining and mixing said old aggregates and old thermoplastic binder and said new aggregates and new thermoplastic binder following said separate heating of said larger fragments of said paving material.

5. The method of claim 2 wherein said paving material is fragmentized old concrete formed of aggregates and thermoplastic binder, including the further step of relaying the heated and remixed material to form new pavement therefrom.

6. The method of claim 5 including the further steps of obtaining said paving material by fragmentizing old pavement at a specific location, and relaying said heated and remixed material at said location to form restored pavement thereat.

7. The method of claim 2 including the further steps of directing said smaller fragments to a first location and directing said larger fragments to a separate second location, performing said heating of said smaller fragments by exposing said smaller fragments to hot gas at said first location, performing said separate heating of said larger fragments by directing said microwave energy into said larger fragments at said second location, and supplementing said microwave heating of said larger fragments by also exposing said larger fragments to hot gas at said second location.

8. The method of claim 7 including directing a flow of hot gas to said first location to heat said smaller fragments thereat and directing a least a portion of said flow to said second location for said supplemental heating of said larger fragments.

9. The method of claim 2 including the further steps of driving at least one electrical generator with at least one fuel consuming engine, and using electrical energy produced by said generator to provide said microwave energy for heating said larger fragments by generating heat internally therein while using exhaust gas produced by said engine for applying said heat from an external heat source to said surfaces of said smaller fragments.

10. The method of claim 9 including the further step of directing a flow of said exhaust gas to said paving material during said remixing of said larger and smaller fragments.

11. In a hot-mix plant, the combination comprising:

a rotary drum-mixer having a first stage with a new aggregates receiving port and a second stage with a reclaimed material port for receiving fragmented old asphaltic concrete or the like for intermixing with material heated in said first stage, means for establishing a hot gas flow within said drum-mixer, means for selectively feeding new aggregates into said new aggregates receiving port, a sorter for separating large fragments of said old asphaltic concrete or the like that exceed a predetermined size from small fragments which are of lesser size, a microwave heating chamber, and a conveyor system interconnecting said drum-mixer and said sorter and said microwave heating chamber and having means for carrying said small fragments from said sorter to said reclaimed material port of said drum-mixer, means for carrying said large fragments from said sorter to said microwave heating chamber, and means for recombining said large fragments with said small fragments following heating of said large fragments in said microwave heating chamber.

12. A recycler for heating and remixing reclaimed asphaltic concrete fragments or the like, comprising:

a housing having a first heating chamber and a second heating chamber therein, said first heating chamber being below said second heating chamber, first heating means for establishing a hot gas flow in said first heating chamber, second heating means for directing microwave energy into materials within said second heating chamber, a sorting screen having openings which pass ones of said fragments that are smaller than a predetermined size, said screen being positioned in said housing to receive said fragments of asphaltic concrete or the like and to pass said smaller fragments to said first heating chamber while directing larger fragments to said second heating chamber, inlet structure secured to said housing in position to receive said fragments and to direct said fragments to said sorting screen, and a mixing device having an inlet communicated with both said first heating chamber and said second heating chamber to receive and mix heated material from each thereof.

13. A recycler as defined in claim 12 further including a first conveyor extending within said first heating chamber to carry material therethrough and having an end portion which is below said sorting screen to receive fragments which drop therethrough, and a second conveyor extending within said second heating chamber to carry material therethrough and having an end portion positioned to receive said larger fragments from said sorting screen.

14. Apparatus for heating fragmented paving material that includes loose fragments of different sizes, comprising:

first heating means for heating fragments within a first heating chamber at least predominately by applying externally produced heat to the surfaces of the fragments within the first heating chamber, means for generating microwave energy, second heating means for generating heat internally within fragments in a second heating chamber by directing at least most of said microwave energy into said second heating chamber, sorting means for separating large fragments that exceed a predetermined size from small fragments of lesser size, means for transferring said small fragments from said sorting means to said first heating chamber and for transferring said large fragments from said sorting means to said second heating chamber, means for recombining said large fragments with said small fragments following microwave heating of said large fragments in said second heating chamber, and mixing means for remixing the recombined large and small fragments.

15. The apparatus of claim 14 wherein said first heating means includes fuel burning means for providing a flow of hot gas within said first heating chamber.

16. The apparatus of claim 14 further including means for directing hot gas to the surfaces of the large fragments within said second heating chamber to supplement said microwave heating of said large fragments therein.

17. The apparatus of claim 14 wherein said sorting means includes a screen having openings of said predetermined size, means for depositing said paving material on said screen, means for directing fragments which pass through said screen to said first heating chamber, and means for delivering the remaining fragments to said second heating chamber.

18. The apparatus of claim 14 wherein said first heating means includes a fuel consuming engine which produces hot exhaust gas and means for transmitting at least a portion of said exhaust gas to said first heating chamber, said apparatus further including an electrical generator driven by said engine and being coupled to said means for generating microwave energy to supply operating electrical power thereto.

19. The apparatus of claim 14 further including ground engaging means for enabling travel of said apparatus along a roadbed or the like, and an elevator attached to said apparatus in position to pick up said paving material from said roadbed or the like and to direct said material to said sorting means.

20. The apparatus of claim 14 further including a first conveyor extending within said first heating chamber and a second conveyor extending within said second heating chamber in position to expose said large fragments to said microwave energy, said first heating chamber and first conveyor being located below said second heating chamber and said second conveyor, and wherein said sorting means includes a screen positioned to receive said paving material and to transmit said small fragments to said first conveyor while transferring the remaining material to said second conveyor.

21. The apparatus of claim 20 further including inlet structure located above said screen in position to deposit incoming paving material on said screen, and wherein said first conveyor extends beneath said screen to receive material which drops therethrough.

22. The apparatus of claim 14 wherein said mixing means is a rotary drum-mixer and wherein said first heating chamber is situated within said drum-mixer.

23. The apparatus of claim 22 wherein said drum-mixer has a first stage with a new aggregates receiving port and a second stage with a reclaimed paving material receiving port and wherein said means for directing small fragments from said sorting means to said first heating chamber feeds said small fragments into said reclaimed paving material port, further including means for feeding new aggregates into said new aggregates receiving port at a selected rate for heating and intermixing with reclaimed paving material.

24. The apparatus of claim 22 further including an additional mixing device, means for selectively delivering heated material from said drum-mixer to said additional mixing device, and switchable conveying means for delivering heated large fragments from said second heating chamber to said reclaimed materials port in one mode of operation and for delivering said heated large fragments to said additional mixing device independently of said drum-mixer in another mode of operation.

* * * * *